US011338597B2

(12) United States Patent
Kozuma et al.

(10) Patent No.: US 11,338,597 B2
(45) Date of Patent: May 24, 2022

(54) PRINTING APPARATUS

(71) Applicant: SEIKO EPSON CORPORATION, Tokyo (JP)

(72) Inventors: Itaru Kozuma, Matsumoto (JP); Yasushi Yajima, Minowa-machi (JP); Takayuki Tamaki, Shiojiri (JP); Toshiaki Ishikawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/527,517

(22) Filed: Jul. 31, 2019

(65) Prior Publication Data

US 2020/0039253 A1 Feb. 6, 2020

(30) Foreign Application Priority Data

Aug. 2, 2018 (JP) ..... JP2018-145667

(51) Int. Cl.
*B41J 11/66* (2006.01)

(52) U.S. Cl.
CPC ..... *B41J 11/663* (2013.01)

(58) Field of Classification Search
None
See application file for complete search history.

(56) References Cited

U.S. PATENT DOCUMENTS 6,338,436 B1 * 1/2002 Iguchi ..... G07B 1/00 235/456
2004/0218961 A1 11/2004 Hoshino et al.
2004/0252176 A1 * 12/2004 Sugiura ..... B41J 13/14 347/104
2005/0051011 A1 * 3/2005 Onishi ..... B26D 11/00 83/428
2006/0269346 A1 * 11/2006 Takayama ..... B41J 11/666 400/613
2010/0238250 A1 * 9/2010 Kachi ..... B41J 11/0005 347/104
2013/0258023 A1 * 10/2013 Sekino ..... B41J 13/00 347/104

FOREIGN PATENT DOCUMENTS

JP 2004-243606 9/2004
JP 2012-121713 6/2012
JP 2012-176821 A 9/2012

* cited by examiner

*Primary Examiner* — Erica S Lin
(74) *Attorney, Agent, or Firm* — Workman Nydegger

(57) ABSTRACT

A printing apparatus includes a first roller pair configured to convey a continuous medium, a printing head that is located downstream of the first roller pair and that performs printing on the continuous medium, a cutting unit that is located downstream of the printing head and that is configured to cut the continuous medium, a second roller pair that is located downstream of the cutting unit and that is configured to convey the continuous medium, a common driving source configured to apply driving force to the first roller pair and the second roller pair, and a clutch mechanism configured to cut power from the driving source to the second roller pair, wherein the clutch mechanism is a one-way mechanism that transmits the power when the continuous medium is conveyed in a forward direction and does not transmit the power when the continuous medium is conveyed in a reverse direction.

3 Claims, 6 Drawing Sheets

PRINTING APPARATUS

The present application is based on, and claims priority from JP Application Serial Number 2018-145667, filed Aug. 2, 2018, the disclosure of which is hereby incorporated by reference herein in its entirety.

BACKGROUND

1. Technical Field

The present disclosure relates to a printing apparatus.

2. Related Art

Typically, a recording device provided with a sheet storage mechanism that stores a sheet discharged from a discharge port is known (for example, see JP-A-2012-176821).

However, in the recording device described above, there is a problem that, when the sheet is stored in the sheet storage mechanism in a state where a portion on which an image is formed is not sufficiently dried, due to a deformation of the sheet or the like, the portion of the sheet on which the image is formed is rubbed and the image quality is decreased.

SUMMARY

The printing apparatus according to the present application includes a first roller pair configured to sandwich and convey a continuous medium, a printing head that is located downstream of the first roller pair in a conveying direction of the continuous medium and that is configured to perform printing on the continuous medium, a cutting unit that is located downstream of the printing head in the conveying direction of the continuous medium and that is configured to cut the continuous medium, a second roller pair that is located downstream of the cutting unit in the conveying direction of the continuous medium and that is configured to sandwich and convey the continuous medium, a common driving source configured to apply driving force to the first roller pair and the second roller pair, and a clutch mechanism configured to cut power from the driving source to the second roller pair, wherein the clutch mechanism is a one-way mechanism that transmits the power when the continuous medium is conveyed in a forward direction and does not transmit the power when the continuous medium is conveyed in a reverse direction.

The printing apparatus described above may further include a medium detector that is located between the first roller pair and the printing head and that is configured to detect presence of the continuous medium, and a control unit that is configured to, after the continuous medium is cut, convey, in the reverse direction, the continuous medium located at a supply side, and that is configured to, after an end portion at the downstream side of the continuous medium is detected by the medium detector, convey the continuous medium in the forward direction and temporarily stop the continuous medium at a predetermined position, wherein in a state where the continuous medium is temporarily stopped, b>a, a being a distance from the medium detector to an end portion at the downstream side in the conveying direction of the continuous medium, b being a distance from the cutting unit to the second roller pair.

In the printing apparatus described above, each of the first roller pair and the second roller pair may include a driving roller and a driven roller, and a conveying amount of the first roller pair per predetermined driving amount of the driving source may be less than a conveying amount of the second roller pair.

DESCRIPTION OF EXEMPLARY EMBODIMENTS

Hereinafter, embodiments of the present disclosure will be described below with reference to the figures. Note that, in each of the figures below, to illustrate each of members and the like in a recognizable size, each of the members and the like is illustrated to a scale different from an actual scale.

Figure 1:
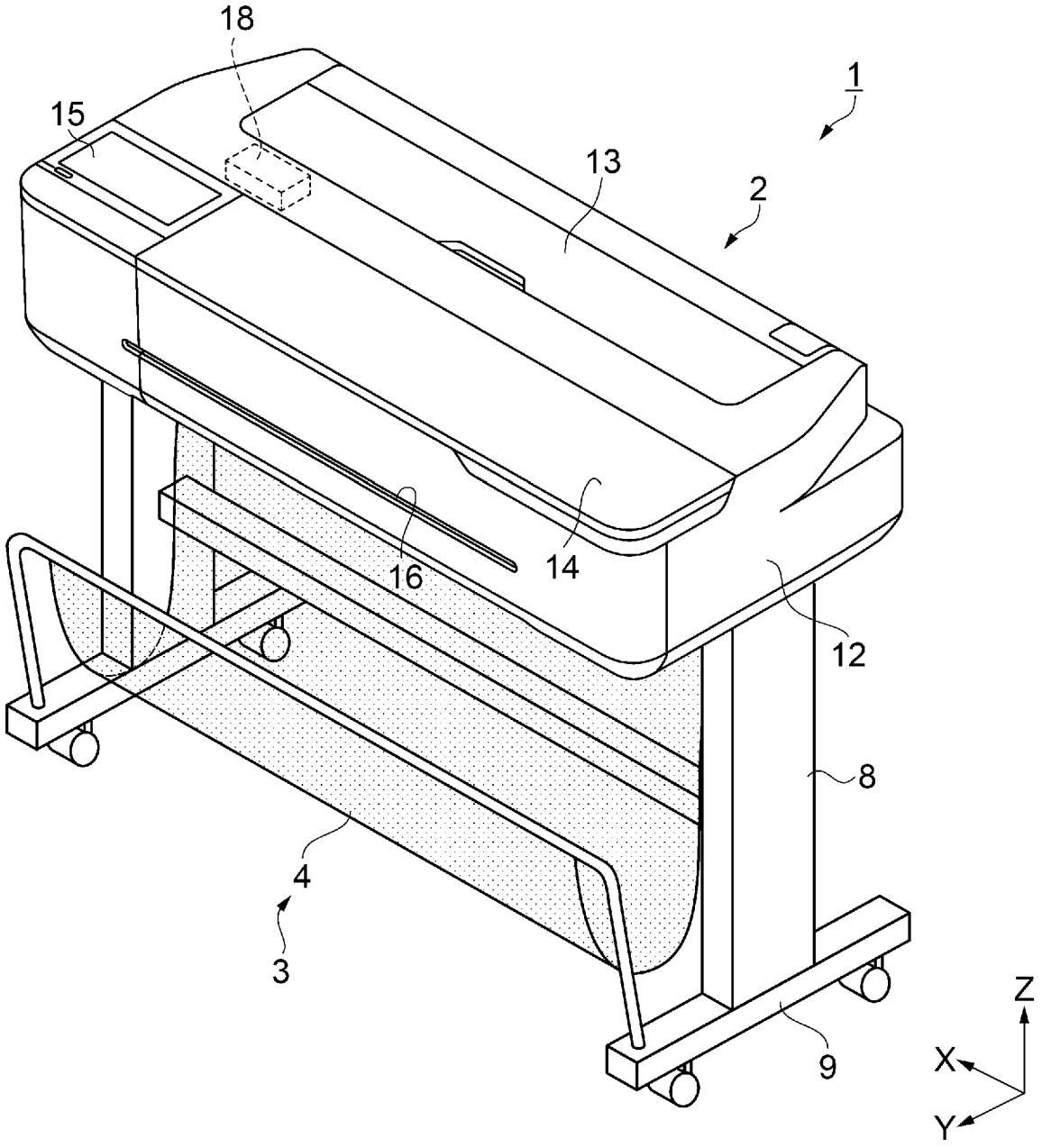
FIG. 1 is a perspective view illustrating a configuration of a printing apparatus.

First, a configuration of a printing apparatus 1 will be described. FIG. 1 is a perspective view illustrating the configuration of the printing apparatus 1. Note that in the following description, the printing apparatus 1 illustrated in FIG. 1 is placed on a horizontal surface, a direction along the upward and downward directions (vertical direction) is illustrated as a Z axis direction, and a direction along the horizontal surface is illustrated as an X axis direction and a Y axis direction. That is, when the printing apparatus 1 is viewed from the front, the X axis direction that is the width direction, the Y axis direction that is the depth direction, and the Z axis direction that is the height direction are different directions and are orthogonal to each other.

As illustrated in FIG. 1, for example, the printing apparatus 1 is an ink jet printer capable of forming an image with respect to sheet S (roll paper) as a continuous medium with a relatively large size, such as an AO size or BO size of the JIS standard. The printing apparatus 1 includes a main body 2 and a discharged sheet receiving unit 3. The main body 2 is disposed on the upper portion of a prop 8 that is erected on a base 9. The discharged sheet receiving unit 3 has a stacker 4. The stacker 4 is disposed below the main body 2 and receives the sheet S discharged from the main body 2 side.

The printing apparatus 1 includes a substantially rectangular parallelepiped housing 12. On the top surface of the housing 12, a sheet conveying cover 13 located on the rear side and a maintenance cover 14 located on the front side are provided to be openable and closable. An operation panel 15 for performing various operations of the printing apparatus 1 is disposed at a position adjacent to the maintenance cover 14 in the X axis direction on the upper surface of the housing 12. Then, a discharge port 16 that allows discharging of the sheet S on which the image is formed in the housing 12 is disposed on the front surface of the housing 12 on the +Y direction side in the Y axis direction. In the present embodiment, the +Y direction in the Y axis direction coincides with the discharge direction of the sheet S.

Figure 2:
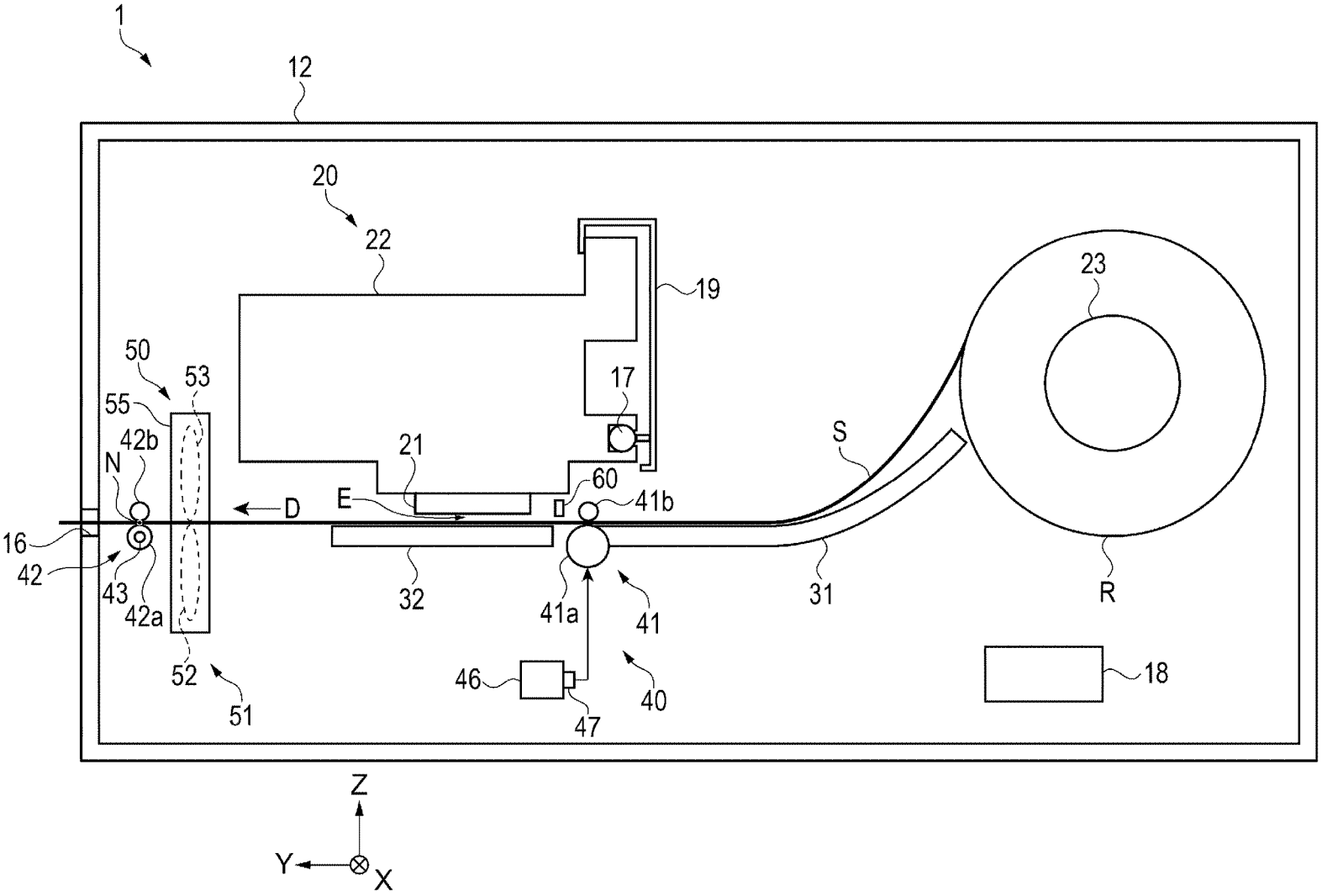
FIG. 2 is a schematic view illustrating the configuration of the printing apparatus.

FIG. 2 is a schematic view illustrating the configuration of the printing apparatus 1. As illustrated in FIG. 2, the housing 12 of the printing apparatus 1 includes a recording unit 20 that records an image such as characters and photographs on the sheet S, and a first support member 31 and a second support member 32 that support the sheet S. In addition, the housing 12 of the printing apparatus 1 includes a conveying unit 40 that conveys the sheet S, and a cutting unit 50 that cuts the sheet S recorded by the recording unit 20. Then, a control unit 18 that controls each of the components of the printing apparatus 1 is provided.

A roll body R in which the sheet S is wound in a roll shape is arranged in the housing 12. The roll body R is arranged rearward in the housing 12 in FIG. 2. The roll body R is rotatably supported by a shaft 23 disposed to extend in the width direction (X axis direction) of the sheet S. According to the present embodiment, the sheet S is conveyed out from the roll body R by rotating the shaft 23 in the counterclockwise direction in FIG. 2. The conveyed out sheet S is conveyed by the conveying unit 40 and is discharged from the housing 12 to the outside of the housing 12 through the discharge port 16 that opens to the front surface of the housing 12. That is, according to the present embodiment, a direction from the rear to the front of the housing 12 is a conveying direction D of the sheet S conveyed by the conveying unit 40.

The recording unit 20 includes a printing head 21 (for example, an ink jet head) that ejects ink as a liquid toward the sheet S and prints on the sheet S, and a carriage 22 on which the printing head 21 is mounted. The carriage 22 is supported by a frame 19 disposed in the housing 12 and a guide shaft 17 attached to the frame 19. The guide shaft 17 extends in the width direction (X axis direction) of the sheet S. The carriage 22 is movable along the guide shaft 17 by the power of a motor (not illustrated). That is, the carriage 22 reciprocates in a direction (X axis direction) that intersects the conveying direction D of the sheet S. The printing head 21 can eject ink on the sheet S across the X axis direction (width direction) by moving the carriage 22 along the guide shaft 17.

The first and second support members 31 and 32 are configured by plate-shaped members. The first support member 31 is arranged upstream of the second support member 32 in the conveying direction D of the sheet S, and guides the sheet S conveyed out from the roll body R toward the recording unit 20. The second support member 32 is arranged to face the printing head 21 of the recording unit 20. At the ejected position E where the second support member 32 and the printing head 21 face each other, ink is ejected from the printing head 21 onto the sheet S.

The conveying unit 40 conveys the sheet S conveyed out from the roll body R toward the discharge port 16 from within the housing 12 along the first and second support members 31 and 32 while sandwiching the sheet S. In the conveying unit 40 of the present embodiment, the first roller pair 41 is arranged on the most upstream in the conveying direction D, and the second roller pair 42 is arranged on the most downstream in the conveying direction D.

The first roller pair 41 is arranged upstream of the printing head 21 in the conveying direction D and is arranged between the first support member 31 and the second support member 32. The first roller pair 41 sandwiches and conveys the sheet S and includes a first driving roller 41*a* and a driven roller 41*b* which is capable of being driven to rotate with respect to the rotation of the first driving roller 41*a*. The second roller pair 42 includes a second driving roller 42*a* and a driven roller 42*b* which is capable of driven rotation with respect to the rotation of the second driving roller 42*a*.

The first and second driving rollers 41*a* and 42*a* are driven by a motor 46 as a common driving source. In the present embodiment, the first driving roller 41*a* of the first roller pair 41 and the motor 46 are coupled. The first driving roller 41*a* and the second driving roller 42*a* are coupled by a transmission gear. Then, the first and second driving rollers 41*a* and 42*a* are driven to rotate by the driving of the motor 46. As a result, the first and second roller pairs 41 and 42 can rotate in a state in which the sheet S is sandwiched by the first and second driving rollers 41*a* and 42*a* and the driven roller 41*b* and 42*b*, and can convey the sheet S along the conveying direction D. Here, it is conceivable that the driving source (motor) is arranged individually with respect to each of the first and second driving rollers 41*a* and 42*a*, but in this case, there is a risk that conveying amount of the sheet S is shifted and conveying accuracy is reduced due to the occurrence of dispersion in the conveying accuracy of the first and second driving rollers 41*a* and 42*a*. Therefore, in the present embodiment, the conveying accuracy of the sheet S is improved by driving the first and second driving rollers 41*a* and 42*a* by the common driving source (motor 46).

In addition, a rotary encoder 47 as a measuring means is arranged on the motor 46. The rotary encoder 47 is coupled to the control unit 18. The rotary encoder 47 is a sensor that converts the amount of mechanical displacement of rotation into an electrical signal, and processes the signal to detect position, speed, and the like. According to the embodiment, the rotary encoder 47 is used to position the end portion Sa on downstream of the sheet S described below. The rotary encoder 47 is configured by a slit disk fixed to a rotary shaft of the motor 46, and a position detector disposed at a position where the peripheral edge of the slit disk passes. A plurality of position detection slits are formed at equal intervals throughout the entire circumference of the slit disk along the peripheral edge. Then, the position detector includes a light emitting unit configured by a light emitting diode, and a light receiving unit configured by a phototransistor so as to face each other via the peripheral edge of the slit disk. Then, the position detector is configured to output an electrical signal from the light receiving unit when light from the light emitting unit passes through the position detection slit of the slit disk and received by the light receiving unit.

The first and second driving rollers 41*a* and 42*a* are arranged to contact with the sheet S from below. The driven roller 41*b* and 42*b* are arranged to contact the sheet S from above. The driven roller 42*b*, when conveying the sheet S, contacts the surface of the sheet S on which the ink is ejected. Therefore, the driven roller 42*b* is configured by a star wheel having a small contact area with respect to the sheet S, or the like in order to reduce deterioration of the quality of the image recorded in the sheet S. Note that the configuration of the driven roller 41*b* is the same as that of the driven roller 42*b*. A plurality of the first and second roller pairs 41 and 42 are arranged at predetermined intervals in the width direction.

The cutting unit 50 is arranged between the printing head 21 and the second roller pair 42 in the conveying direction D. The sheet S cut by the cutting unit 50 is discharged from the discharge port 16 via conveying by the second roller pair 42. Note that the printing apparatus 1 according to the present embodiment is configured with a relatively small interval in the vertical direction Z in the opening of the discharge port 16 so that fingers of a user cannot be inserted into the housing 12 from the discharge port 16. Therefore, by disposing the second roller pair 42 near upstream of the discharge port 16, the sheet S can be smoothly conveyed toward the discharge port 16, and sheet jam can be prevented from occurring.

The cutting unit 50 includes a cutting blade 51 for cutting the sheet S and a holding body 55 that holds the cutting blade 51. The cutting blade 51 is configured by a disk-shaped driving blade 52 and a disk-shaped driven blade 53. The driving blade 52 and the driven blade 53 are rotatably attached to the holding body 55. The driving blade 52 and the driven blade 53 are disposed to be aligned in the vertical direction. The holding body 55 is capable of reciprocating along the X axis direction. The cutting unit 50 cuts the sheet S by the cutting blade 51 by moving the holding body 55 along the X axis direction. That is, the sheet S is cut by scanning the cutting unit 50 including the cutting blade 51 in the X axis direction that intersects the conveying direction D of the sheet S.

The cutting unit 50 includes a driving source such as a motor, to reciprocate the cutting unit 50 along the X axis direction by driving force of the motor. Note that the cutting unit 50 and the carriage 22 may be coupled, and the cutting unit 50 may reciprocate along the X axis direction by the power of the motor that moves the carriage 22.

In addition, a medium detector 60 is arranged between the first roller pair 41 and the printing head 21 in the conveying direction D. The medium detector 60 is a sensor that detects the presence of the sheet S. The medium detector 60 is coupled to the control unit 18, and the motor 46 is controlled based on detection data from the medium detector 60. For example, the medium detector 60 is a photo-interrupter, and includes a light emitting unit that emits light and a light receiving unit that receives light emitted from the light emitting unit. For example, as a light emitting element of the light emitting unit, a Light Emitting Diode (LED) light emitting element, a laser light emitting element or the like are applied. In addition, the light receiving unit is configured by a phototransistor, a photo IC and the like. Then, a change in light receiving amount between the light emitting unit and the light receiving unit is converted into an electrical signal and output as detection data. The control unit 18 determines the presence of the sheet S based on the detection data, and controls the motor 46.

Here, a clutch mechanism 43 configured to be able to cut the power from the motor 46 to the second roller pair 42 is disposed on the conveying unit 40. That is, the clutch mechanism 43 is disposed between the motor 46 and the second driving roller 42*a*. The clutch mechanism 43 is a one-way mechanism (one-way clutch). In the clutch mechanism 43 of the present embodiment, when the sheet S is conveyed in the forward direction along the conveying direction D, the power is transmitted to the second driving roller 42*a*. On the other hand, when the sheet S is conveyed in the reverse direction to the opposite direction of the conveying direction D, transmission of the power to the second driving roller 42*a* is cut.

In addition, conveying amount of the sheet S of the first roller pair 41 per predetermined driving amount of the motor 46 is smaller (lower) than conveying amount of the sheet S of the second roller pair 42. In other words, the second driving roller 42*a* is driven to accelerate with respect to the first driving roller 41*a*. It is possible to drive the speed increasing by adjusting the diameter of the first driving roller 41*a* and the second driving roller 42*a*, gear ratio, and the like. When the printing head 21 ejects ink onto the sheet S to form an image, in a case where the sheet S is extended due to the reception of ink, the sheet S bends and contacts the printing head 21, and an ejection failure of the printing head 21 occurs. Accordingly, by making the conveying amount of the second driving roller 42*a* arranged downstream in the conveying direction D of the second support member 32 including the ejected position E larger than that of the first driving roller 41*a*, tension can be applied to the sheet S, the occurrence of bending of the sheet S can be suppressed, and the occurrence of ejection failure can be prevented.

Figure 3:
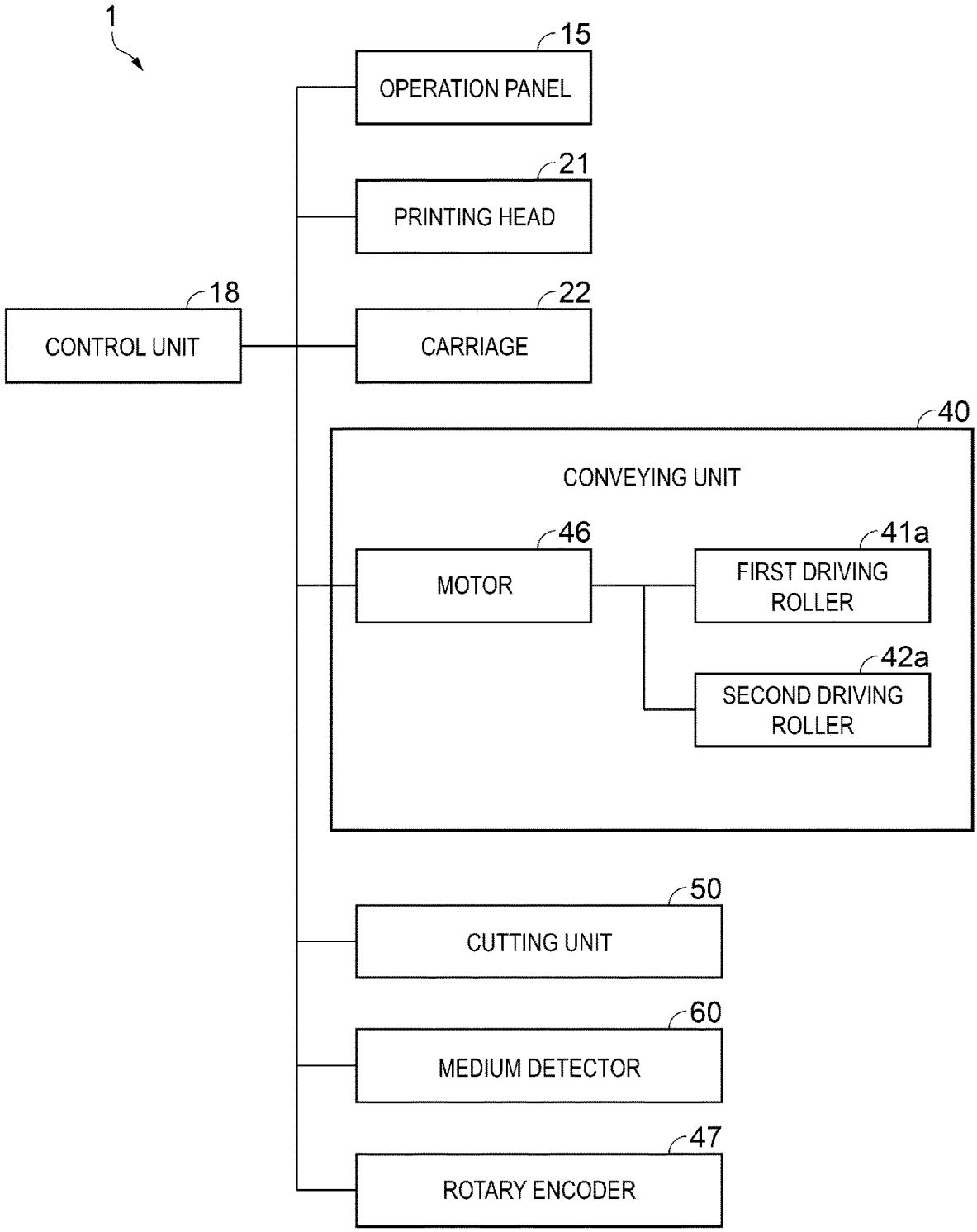
FIG. 3 is a block diagram illustrating a control configuration of the printing apparatus.

Next, the control configuration of the printing apparatus 1 will be described. FIG. 3 is a block diagram illustrating the control configuration of the printing apparatus 1. As illustrated in FIG. 3, the control unit 18 is coupled to the operation panel 15, the printing head 21, the carriage 22, the conveying unit 40, the cutting unit 50, the medium detector 60, and the rotary encoder 47. The control unit 18 includes a Central Processing Unit (CPU) for executing various programs, a Random Access Memory (RAM) for temporarily storing data, programs, and the like, a Read Only Memory (ROM) in which various data, various programs, and the like are recorded in advance in a non-volatile manner, and an interface. Then, the CPU processes various signals input via the interface based on data in the RAM and the ROM, and outputs control signals to each unit via the interface. The control unit 18 receives operation information of the user operation from the operation panel 15, controls the carriage 22 (motor), the printing head 21, the motor 46 of the conveying unit 40 and the cutting unit 50 (motor), and executes a printing operation (image forming process) and a cutting operation of the sheet S. In addition, the motor 46 is driven and controlled based on the detection data of the medium detector 60 and the rotary encoder 47.

Next, the control method of the printing apparatus 1 will be described. FIG. 4A to FIG. 4E are schematic views illustrating the control method of the printing apparatus 1. In the control method of the printing apparatus 1 described below, each unit is driven and controlled based on a control signal of the control unit 18.

Figure 4A:
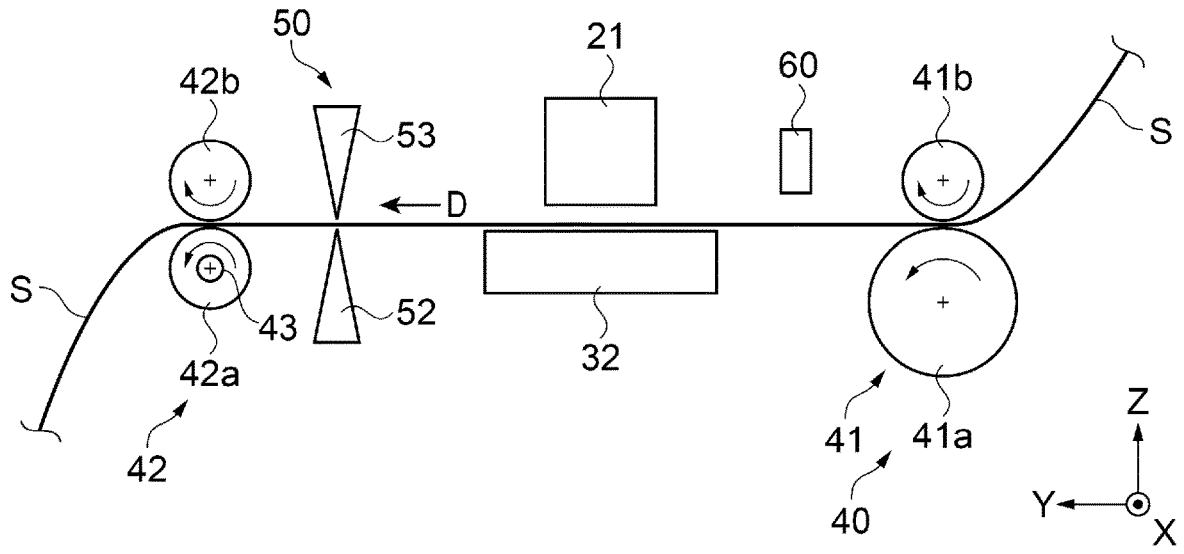
FIG. 4A is a schematic view illustrating a control method of the printing apparatus.

As illustrated in FIG. 4A, the control unit 18 drives the motor 46 of the conveying unit 40 to rotate in a forward direction to intermittently move the sheet S. Then, at each stop in the intermittent movement by the conveying unit 40, the carriage 22 is moved in the X axis direction, and ink is ejected from the printing head 21 mounted on the carriage 22 toward the sheet S. As a result, a desired image is printed on the sheet S (image forming process). Note that during the process of image forming, the first and second driving rollers 41*a* and 42*a* are driven to rotate in the counterclockwise direction in FIG. 4A. The sheet S on which the image is formed is conveyed in the conveying direction D by the conveying unit 40, and is discharged from the discharge port 16 (see FIG. 2).

Figure 4B:
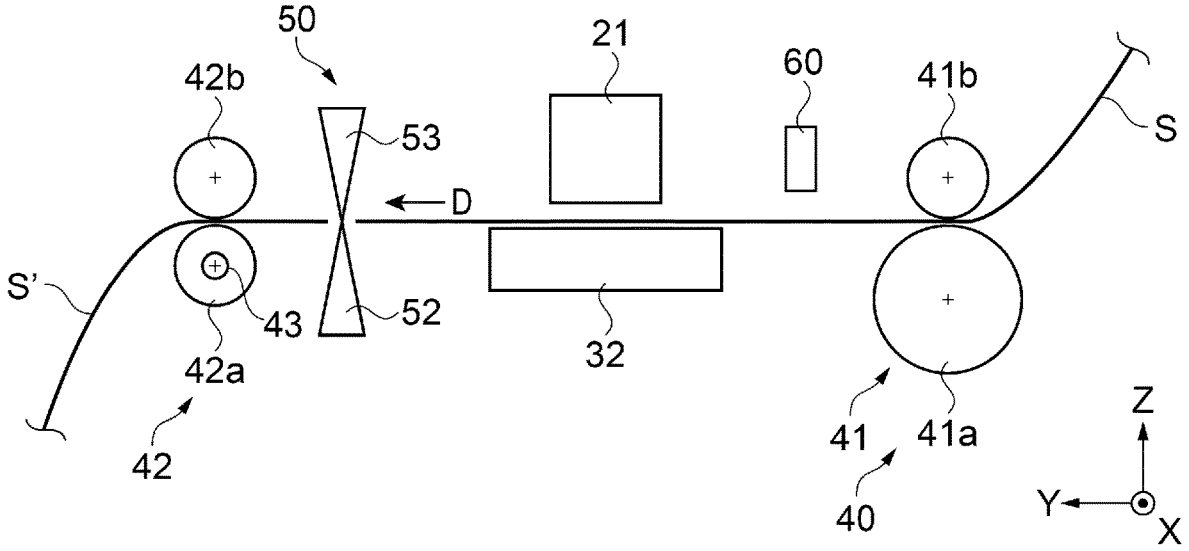
FIG. 4B is a schematic view illustrating the control method of the printing apparatus.

Next, as illustrated in FIG. 4B, after the predetermined recording operation is completed, that is, after the predetermined image is printed on the sheet S, the control unit 18 drives the cutting unit 50 to cut the sheet S. Specifically, the control unit 18 stops the conveying unit 40, and stops the conveying of the sheet S. Thereafter, the control unit 18 moves the cutting unit 50 in the X axis direction. As a result, the sheet S is cut. The sheet S' as a continuous medium cut by the cutting unit 50, is held in a state of being nipped by the second roller pair 42.

Figure 4C:
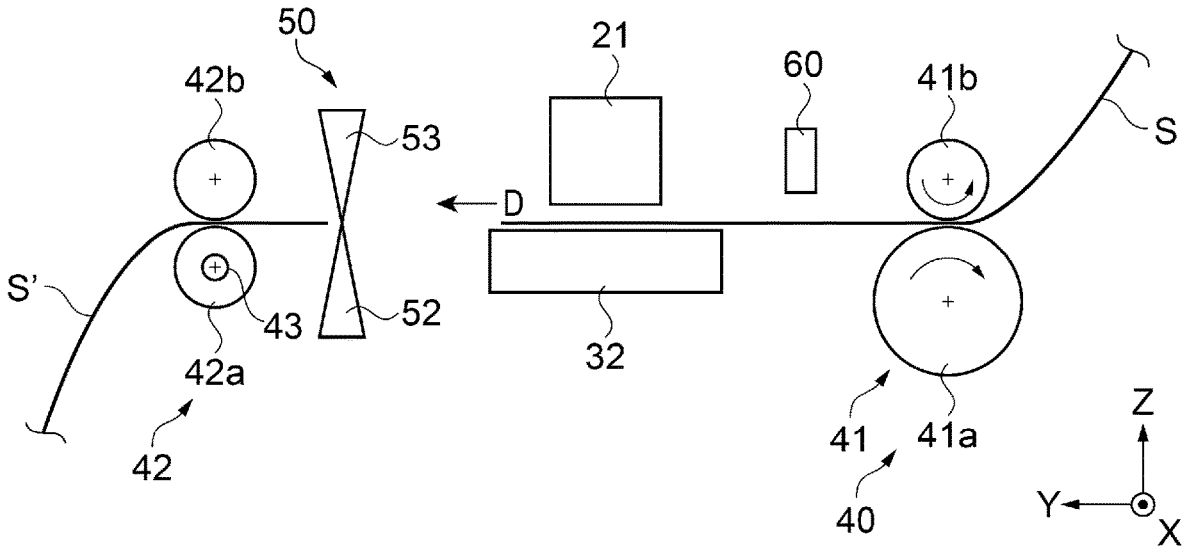
FIG. 4C is a schematic view illustrating the control method of the printing apparatus.

Next, as illustrated in FIG. 4C, the control unit 18 conveys the sheet S located on the supply side (roll body R side) in the reverse direction. That is, the sheet S is conveyed in a direction opposite to the conveying direction D. Specifically, the control unit 18 drives the motor 46 to rotate in the reverse direction opposite to the forward direction. As a result, the first driving roller 41*a* rotates in the clockwise direction in FIG. 4C. Then, the sheet S is conveyed in the direction opposite to the conveying direction D by the rotation of the first roller pair 41. Note that when the motor 46 is driven to rotate in the reverse direction, that is, when the motor 46 is driven to rotate in the direction of conveying the sheet S on the supply side upstream, the first driving roller 41*a* rotates in the clockwise direction in FIG. 4C, but the second driving roller 42*a* is released from the transmission of the power to the second driving roller 42*a* by the clutch mechanism 43. Therefore, the second roller pair 42 including the second driving roller 42*a* is held in a state when the sheet S' is cut. That is, the cut sheet S' does not move upstream in the conveying direction D, and the sheet S' does not conflict with the cutting unit 50 and the like. Then, drying of the ink applied on the sheet S' is promoted via holding the sheet S' by the second roller pair 42.

Figure 4D:
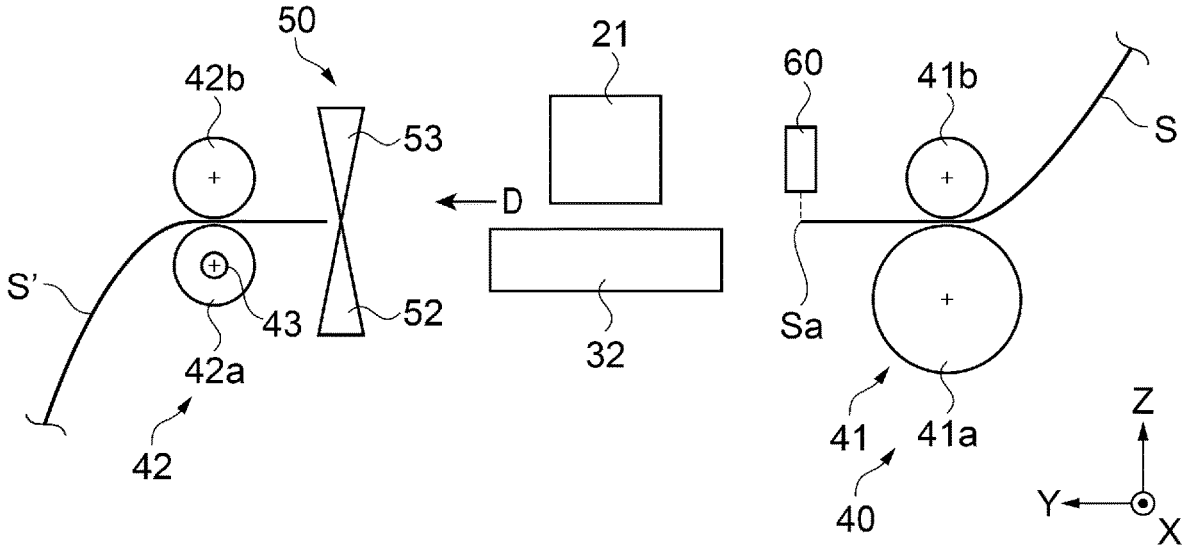
FIG. 4D is a schematic view illustrating the control method of the printing apparatus.

Next, as illustrated in FIG. 4D, the control unit 18 stops the reverse conveying of the sheet S in a case where the downstream end portion Sa of the sheet S conveyed in the reverse direction is detected by the medium detector 60. Specifically, based on the detection data of the medium detector 60, that is, based on the change data of the light receiving amount by the light receiving unit, when the downstream end portion Sa of the sheet S is detected, the control unit 18 determines that the sheet S is not present, and stops driving the motor 46.

Figure 4E:
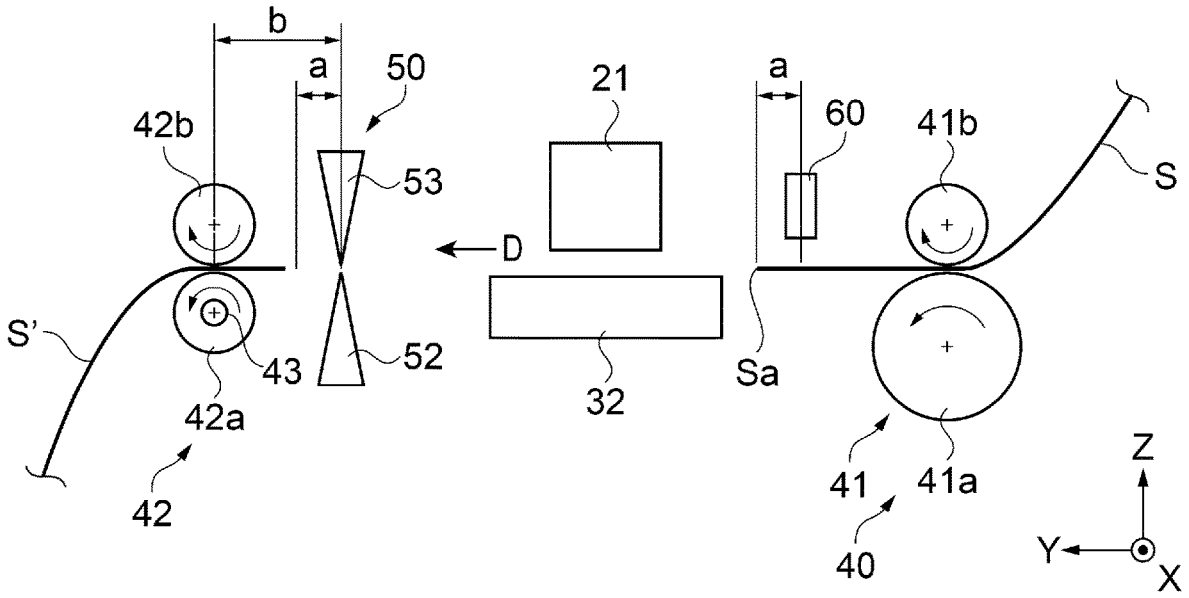
FIG. 4E is a schematic view illustrating the control method of the printing apparatus.

Next, as illustrated in FIG. 4E, the control unit 18 conveys the sheet S in the forward direction and temporarily stops the downstream end portion Sa of the sheet S at a predetermined position. Specifically, the motor 46 is driven to rotate in the forward direction. As a result, the first and second driving rollers 41*a* and 42*a* rotate counterclockwise. Then, based on the detection data from the rotary encoder 47, when the downstream end portion Sa of the sheet S reaches the predetermined position, the drive of the motor 46 is stopped. In the control unit 18, the detection data (output value) from the rotary encoder 47 corresponding to a distance from a position where the downstream end portion Sa of the sheet S is detected by the medium detector 60 to the predetermined position is stored in advance.

Here, the predetermined position of the downstream end portion Sa of the sheet S is a position where the downstream end portion Sa is moved from the medium detector 60 in the conveying direction D by a distance a. Then, as illustrated in FIG. 4E, in a state where the sheet S on the supply side is temporarily stopped, a distance from the medium detector 60 to the downstream end portion Sa in the conveying direction D of the sheet S is set to be a, and a distance from the cutting unit 50 to the second roller pair 42 is set to be b, the relationship of b>a is established. Note that, for example the distance a can be set as the distance between the center portion of the light receiving surface of the light receiving unit of the medium detector 60 and the downstream end portion Sa of the sheet S when viewed from the Z direction. In addition, the distance b can be set as the distance between the +Z direction end portion of the driving blade 52 of the cutting unit 50 and the center portion of the nipping of the second roller pair 42 in the conveying direction D when viewed from the Z direction. When the sheet S is conveyed in the forward direction, the first and second driving rollers 41*a*, and 42*a* drive counterclockwise, so the second roller pair 42 conveys the cut sheet S' at least a distance a downstream in the conveying direction D. However, since the distance b>distance a, the cut sheet S' does not separate from the second roller pair 42. Therefore, the state of holding (nipping) the sheet S' printed by the second roller pair 42 can be maintained. Note that since the second driving roller 42*a* is configured to be driven at an increased speed with respect to the first driving roller 41*a*, in fact, it will move a little longer than the distance a and move more in the conveying direction D. Therefore, the distance b between the cutting unit 50 and the second roller pair 42 is set such that the distance b>the distance a, in consideration of the acceleration of the second driving roller 42*a*.

By holding (nipping) the sheet S' printed by the second roller pair 42, drying of the ink applied on the sheet S' can be reliably performed. Note that the user can pull out the sheet S' in the +Y direction in a state where the sheet S' is nipped by the second roller pair 42 as appropriate. Thereafter, the next image forming process starts with respect to the sheet S, and when the second roller pair 42 is driven in conjunction with conveying the sheet S in the conveying direction D, the sheet S' is conveyed in the conveying direction D and is separated from the second roller pair 42 and is stored by the stacker 4. Here, the sheet S' is stored in the stacker 4 in a state where drying of the ink applied on the sheet S' is advanced while being nipped by the second roller pair 42. Hereinafter, FIG. 4A to FIG. 4E are repeated.

According to the present embodiments, the following advantages can be obtained.

The sheet S on which the image is printed by the printing head 21 is conveyed in the conveying direction D by the first roller pair 41 and the second roller pair 42, and cut by the cutting unit 50. Here, when the sheet S is moved upstream (reverse direction) in the conveying direction D by driving the first roller pair 41 in reverse rotation, the power of the second roller pair 42 is cut off by the clutch mechanism 43 and the second roller pair 42 is not driven. That is, the cut sheet S' is held in a state of being held (nipped) by the second roller pair 42, and the sheet S' is not conveyed upstream in the conveying direction D of the cutting unit 50. As a result, drying of the sheet S' after image printing can be reliably performed.

Contents derived from the embodiments will be described below.

The printing apparatus includes a first roller pair configured to sandwich and convey a continuous medium, a printing head that is located downstream of the first roller pair in a conveying direction of the continuous medium and that is configured to perform printing on the continuous medium, a cutting unit that is located downstream of the printing head in the conveying direction of the continuous medium and that is configured to cut the continuous medium, a second roller pair that is located downstream of the cutting unit in the conveying direction of the continuous medium and that is configured to sandwich and convey the continuous medium, a common driving source configured to apply driving force to the first roller pair and the second roller pair, and a clutch mechanism configured to cut power from the driving source to the second roller pair, wherein the clutch mechanism is a one-way mechanism that transmits the power when the continuous medium is conveyed in a forward direction and does not transmit the power when the continuous medium is conveyed in a reverse direction.

According to this configuration, the continuous medium on which the image is printed by the printing head is conveyed in the conveying direction by the first roller pair and the second roller pair, and cut by the cutting unit. Here, the continuous medium upstream of the cutting unit may be pulled back to a predetermined position in preparation for the next printing process. In this case, the continuous medium is moved upstream (reverse direction) in the conveying direction by driving the first roller pair in reverse rotation. At this time, the power of the second roller pair is cut off by the clutch mechanism and the second roller pair is not driven. That is, the cut continuous medium is held in a state of being held (nipped) by the second roller pair. As a result, drying after image printing of the cut continuous medium can be promoted.

The printing apparatus described above may further include a medium detector that is located between the first roller pair and the printing head and that is configured to detect presence of the continuous medium, and a control unit that is configured to, after the continuous medium is cut, convey, in the reverse direction, the continuous medium located at a supply side, and that is configured to, after an end portion at the downstream side of the continuous medium is detected by the medium detector, convey the continuous medium in the forward direction and temporarily stop the continuous medium at a predetermined position, wherein in a state where the continuous medium is temporarily stopped, b>a, a being a distance from the medium detector to an end portion at the downstream side in the conveying direction of the continuous medium, b being a distance from the cutting unit to the second roller pair.

According to this configuration, when the continuous medium is cut, the continuous medium on the supply side is conveyed in the reverse direction for the next printing process. Note that, at this time, the cut continuous medium is held in a state of sandwiching by the second roller pair by the clutch mechanism. Thereafter, after the continuous medium on the supply side is detected by the medium detector, the continuous medium is conveyed in the forward direction along the conveying direction, and temporarily stopped at the predetermined position. At this time, the second roller pair is driven by the power of the driving source, and the cut continuous medium is conveyed downstream in the conveying direction. Here, a distance a from the medium detector to the end portion on downstream in the conveying direction of the continuous medium is shorter than the distance b from the cutting unit to the second roller pair. That is, when the continuous medium is conveyed in the forward direction, the second roller pair conveys the cut continuous medium downstream in the conveying direction, but the cut continuous medium does not separate from the second roller pair. Therefore, the continuous medium printed by the second roller pair can be held (nipped) and held dry.

In the printing apparatus described above, each of the first roller pair and the second roller pair may include a driving roller and a driven roller, and a conveying amount of the first roller pair per predetermined driving amount of the driving source may be less than a conveying amount of the second roller pair.

According to this configuration, the conveying amount of the first roller pair per predetermined driving amount of the driving source is smaller (less) than the conveying amount of the second roller pair. That is, the driving roller of the second roller pair is driven at an increased speed faster than the driving roller of the first roller pair. As a result, tension is applied to the continuous medium, and ink can be ejected from the printing head in a state where the continuous medium does not bend at the ejected position. Therefore, the image quality can be improved.

What is claimed is:

1. A printing apparatus comprising:

a first roller pair configured to sandwich and convey a continuous medium;

a printing head that is located downstream of the first roller pair in a conveying direction of the continuous medium and that is configured to perform printing on the continuous medium;

a cutting unit that is located downstream of the printing head in the conveying direction of the continuous medium and that is configured to cut a portion of medium off the continuous medium;

a second roller pair that is located downstream of the cutting unit in the conveying direction of the continuous medium and that is configured to sandwich and convey the portion of medium;

a motor coupled to both the first roller pair and the second roller pair, wherein the first roller pair and the second roller pair are coupled such that the motor is configured to apply a driving force to the first roller pair and the second roller pair;

a clutch mechanism configured to cut power from a driving source to the second roller pair; and a controller configured to control the printing head, the cutting unit, and the motor, wherein:

the printing head is located between the first roller pair and the cutting unit in a conveying direction of the continuous medium, the clutch mechanism is a one-way mechanism that transmits the power to the second roller pair when the motor rotates in a forward direction and does not transmit the power to the second roller pair when the motor rotates in a reverse direction that is opposite to the forward direction, and the controller is configured to:

after cutting the portion of the medium off the continuous medium, cause the motor to rotate in the reverse direction, such that the second roller pair and the cut-off portion of medium do not move due to effect of the clutch mechanism, while the first roller pair conveys the continuous medium in a reverse conveying direction that is opposite to the conveying direction, causing an end portion of the continuous medium to be conveyed reversely to a predetermined position.

2. The printing apparatus according to claim 1, further comprising:

a medium detector that is located between the first roller pair and the printing head and that is configured to detect presence of the continuous medium; wherein:

when the continuous medium is being conveyed in the reverse conveying direction, the medium detector is configured to detect the end portion of the continuous medium, after the end portion of the continuous medium at a downstream side is detected by the medium detector, the control unit cause the motor to rotate in the forward direction to drive both the first roller pair and the second roller pair convey both the cut-off portion of medium and the continuous medium in the conveying direction and then temporarily stops both the cut-off portion of medium and the continuous medium at a predetermined position, wherein in a state where the continuous medium is temporarily stopped, b>a, a being a distance from the medium detector to an end portion at the downstream side in the conveying direction of the continuous medium, b being a distance from the cutting unit to the second roller pair.

3. The printing apparatus according to claim 1, wherein each of the first roller pair and the second roller pair includes a driving roller and a driven roller and a conveying amount of the first roller pair per predetermined driving amount of the driving source is less than a conveying amount of the second roller pair.

* * * * *